US007047845B2

(12) United States Patent
Macor

(10) Patent No.: US 7,047,845 B2
(45) Date of Patent: May 23, 2006

(54) WRENCH

(75) Inventor: Richard J. Macor, Hunterdon County, NJ (US)

(73) Assignee: Proprietary Technologies, Inc., Hunterdon County, NJ (US)

( * ) Notice: Subject to any disclaimer, the term of this patent is extended or adjusted under 35 U.S.C. 154(b) by 135 days.

(21) Appl. No.: 10/909,643

(22) Filed: Aug. 2, 2004

(65) Prior Publication Data

US 2005/0000326 A1 Jan. 6, 2005

Related U.S. Application Data

(63) Continuation-in-part of application No. 10/241,100, filed on Sep. 11, 2002, now Pat. No. 6,792,833, which is a continuation-in-part of application No. 10/226,055, filed on Aug. 22, 2002, now Pat. No. 6,655,239.

(51) Int. Cl.
*B25B 13/02* (2006.01)

(52) U.S. Cl. ..... 81/177.1; 81/124.3

(58) Field of Classification Search ..... 81/177.1, 81/124.3, 124.4, 125.1; D8/21, 22, 28, 29
See application file for complete search history.

(56) References Cited

U.S. PATENT DOCUMENTS

| | | | | | |
|---|---|---|---|---|---|
| 1,793,714 | A | | 2/1931 | Newberg | |
| 2,795,158 | A | * | 6/1957 | Croll | 173/93 |
| D206,455 | S | * | 12/1966 | Thompson | D8/21 |
| D257,319 | S | * | 10/1980 | Cremer | D8/29 |
| D301,112 | S | * | 5/1989 | Crabtree et al. | D8/21 |
| 5,172,614 | A | | 12/1992 | Monnet | |
| D396,787 | S | * | 8/1998 | Farnan | D8/29 |
| D434,292 | S | | 11/2000 | Hsieh | |
| D481,613 | S | | 11/2003 | Macor | |
| 6,655,239 | B1 | | 12/2003 | Macor | |
| 6,895,837 | B1 | * | 5/2005 | Hsien | 81/125.1 |
| 2005/0199107 | A1 | * | 9/2005 | Hsien | 81/177.1 |
| 2006/0021477 | A1 | * | 2/2006 | Hsien | 81/177.8 |

* cited by examiner

*Primary Examiner*—Debra S Meislin

(57) ABSTRACT

A hand operable wrench is described which comprises a wrench head at one end thereof, and a substantially metallic lever formed as a handle extending in a longitudinal direction from the wrench head. The wrench head has an imaginary axis of wrench rotation, and the handle is formed substantially nontwisted comprising a first handle portion, a second handle portion and a third handle portion. The first handle portion connects to the wrench head, and the second handle portion is longitudinally positioned between the first and third handle portions. The first and third handle portions each have a cross-sectional shape when viewed in a cross-sectional plane substantially perpendicular to the longitudinal direction. The cross-sectional shape of the first handle portion is elongated in a direction substantially perpendicular to the axis of wrench rotation of the wrench head, and, the cross-sectional shape of the third handle portion is elongated in a direction substantially parallel to the axis of wrench rotation of the wrench head.

17 Claims, 6 Drawing Sheets

FIG. 1
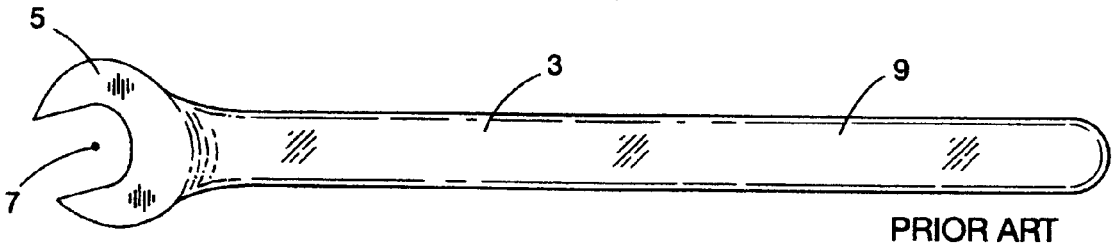
FIG. 2
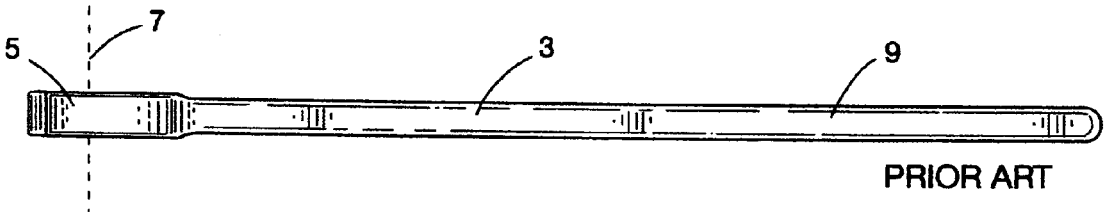
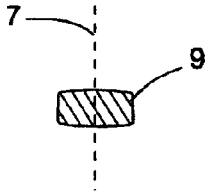
FIG. 3

FIG. 4
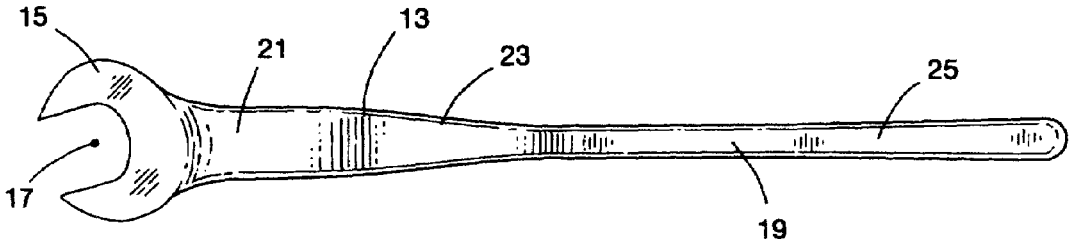
FIG. 5
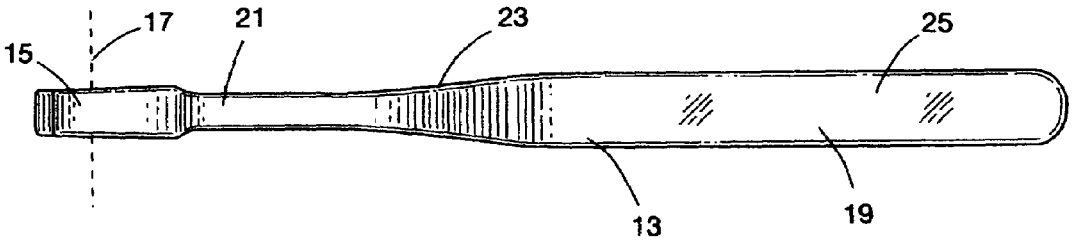
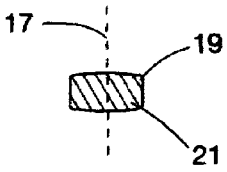
FIG. 6
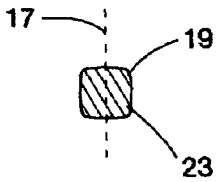
FIG. 7
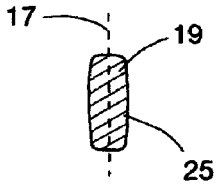
FIG. 8

FIG. 9
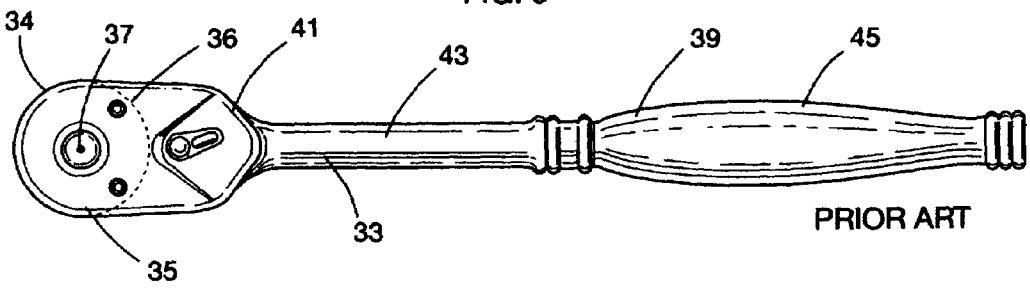
FIG. 10
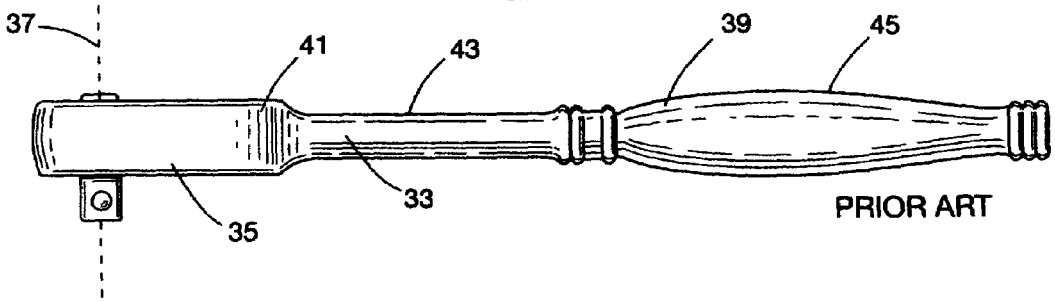
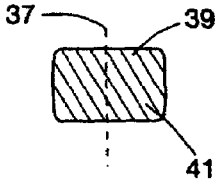
FIG. 11
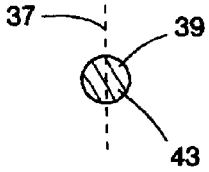
FIG. 12
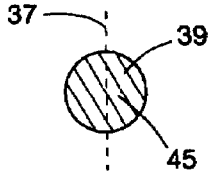
FIG. 13

FIG. 14
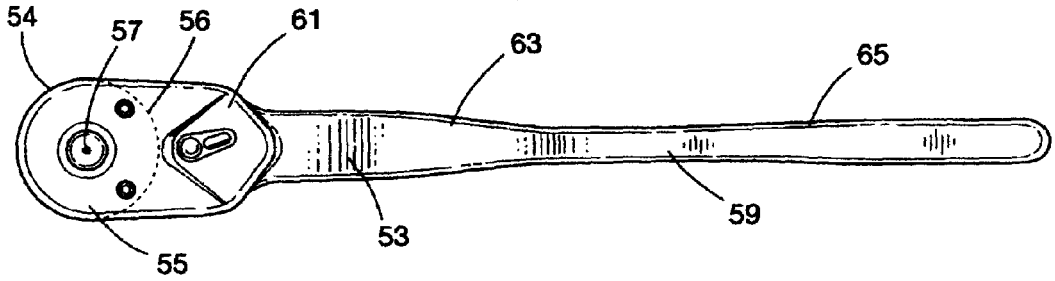
FIG. 15
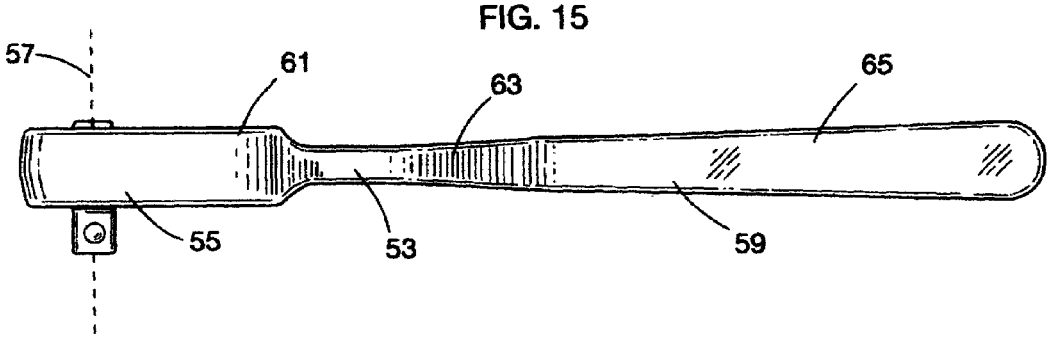
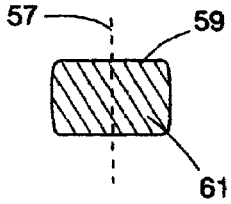
FIG. 16
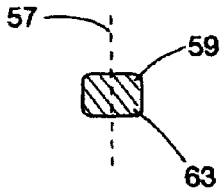
FIG. 17
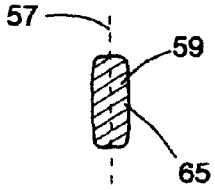
FIG. 18

WRENCH

REFERENCES TO RELATED APPLICATIONS

This application relates to, and is a continuation-in-part of U.S. patent application Ser. No. 10/241,100, filed on Sep. 11, 2002 entitled "Double-ended wrench with ergonomic handle portions," now U.S. Pat. No. 6,792,833, which was a continuation-in-part of U.S. patent application Ser. No. 10/226,055 filed on Aug. 22, 2002 entitled "Double-ended wrench with ergonomic handle," now U.S. Pat. No. 6,655,239. Other related patents and applications filed by the inventor herein include U.S. Pat. No. D481,613 and U.S. patent applications Ser. No. 10/699,272, now U.S. Pat. No. 6,959,628, and Ser. No. 29/191,293, now U.S. Pat. No. D494,833.

FIELD OF THE INVENTION

The present invention relates to hand tools, particularly hand operated wrenches including ratchet wrenches, adjustable wrenches, box wrenches, open-ended wrenches, flex head wrenches and the like.

BACKGROUND OF THE INVENTION

Hand operated wrenches including ratchet wrenches, adjustable wrenches, box wrenches, open-end wrenches, flex head wrenches and the like have been around for many years. These wrenches are often structured having a wrench head at one or both ends thereof, and an elongated handle that is often longer than it is wide, and wider than it is thick. Such handle configurations provide some benefits including excellent clearance accessibility in tight work spaces and excellent handle strength near the wrench head where leverage forces are great. None the less, most prior art wrench handle configurations do not provide adequate surface area for the application of force by a user to turn and operate the wrench, often creating user discomfort and fatigue, while limiting torque and continuous-use capabilities. Manufacturers have often addressed these comfort and torque deficiencies by adding plastic or vinyl type grips, or by twisting the wrench handle to provide a greater surface area for the application of force by a user. Unfortunately, the plastic or vinyl grips increase product cost and often reduce wrench accessibility in tight work spaces. And, the twisted handle configurations can reduce wrench strength, torque capacity, and accessibility to fasteners in some work environments. Applicant also believes the twisted handle configurations may appear damaged or bent to a user, and also feel strange and awkward when handled. Accordingly, applicant believes there is a significant need to improve upon many of the prior art, hand operated wrenches. An improved wrench is contemplated which will provide a user with additional control, comfort and torque capabilities while reducing fatigue and tool related injuries, without sacrificing wrench strength or accessibility in limited-access work environments.

SUMMARY OF THE INVENTION

A hand operable wrench is described which comprises a wrench head at one end thereof, and a substantially metallic lever formed as a handle extending in a longitudinal direction from the wrench head. The wrench head has an imaginary axis of wrench rotation, and the handle is formed substantially nontwisted comprising a first handle portion, a second handle portion and a third handle portion. The first handle portion connects to the wrench head, and the second handle portion is longitudinally positioned between the first and third handle portions. The first and third handle portions each have a cross-sectional shape when viewed in a cross-sectional plane substantially perpendicular to the longitudinal direction. The cross-sectional shape of the first handle portion is elongated in a direction substantially perpendicular to the axis of wrench rotation of the wrench head, and, the cross-sectional shape of the third handle portion is elongated in a direction substantially parallel to the axis of wrench rotation of the wrench head.

Applicant recognizes the need for an improved hand operated wrench, and does accordingly consider the following objectives.

It is an important objective of the present invention described above, that it be structured for excellent accessibility to fasteners, even in limited-access work environments.

It is another important objective of the present invention described above, that it be structured for excellent strength and durability.

It is another important objective of the present invention described above, that it be structured to provide excellent user control, comfort and torque capabilities, while minimizing user fatigue and possible tool related injuries.

It is another important objective of the present invention described above, that it be readily acceptable by professional users.

And, it is yet another important objective of the present invention described above, that it be cost efficient to manufacture and commercially viable.

BRIEF DESCRIPTION OF THE DRAWINGS

FIG. 1 is a top plan view of a prior art open-end type wrench; and,

FIG. 2 is a right side elevational view of the prior art wrench shown in FIG. 1; and, FIG. 3 is a cross-sectional view of a handle portion of the prior art wrench shown in FIGS. 1 and 2; and, FIG. 4 is a top plan view of a present invention open-end type wrench; and, FIG. 5 is a right side elevational view of the present invention wrench shown in FIG. 4; and, FIG. 6 is a cross-sectional view of a first handle portion of the present invention wrench shown in FIGS. 4 and 5; and, FIG. 7 is a cross-sectional view of a second handle portion of the present invention wrench shown in FIGS. 4 and 5; and, FIG. 8 is a cross-sectional view of a third handle portion of the present invention wrench shown in FIGS. 4 and 5; and, FIG. 9 is a top plan view of a prior art ratchet type wrench; and, FIG. 10 is a right side elevational view of the prior art wrench shown in FIG. 9; and, FIG. 11 is a cross-sectional view of a first handle portion of the prior art wrench shown in FIGS. 9 and 10; and, FIG. 12 is a cross-sectional view of a second handle portion of the prior art wrench shown in FIGS. 9 and 10; and, FIG. 13 is a cross-sectional view of a third handle portion of the prior art wrench shown in FIGS. 9 and 10; and, FIG. 14 is a top plan view of a present invention ratchet type wrench; and, FIG. 15 is a right side elevational view of the present invention wrench shown in FIG. 14; and, FIG. 16 is a cross-sectional view of a first handle portion of the present invention wrench shown in FIGS. 14 and 15; and, FIG. 17 is a cross-sectional view of a second handle portion of the present invention wrench shown in FIGS. 14 and 15; and, FIG. 18 is a cross-sectional view of a third handle portion of the present invention wrench shown in FIGS. 14 and 15; and, FIG. 19 is a bottom plan view of a present invention adjustable type wrench; and, FIG. 20 is a right side elevational view of the present invention wrench shown in FIG. 19; and, FIG. 21 is a top plan view of a present invention box type wrench; and, FIG. 22 is a right side elevational view of the present invention wrench shown in FIG. 21.

DETAILED DESCRIPTION OF THE DRAWINGS

Figure 19:
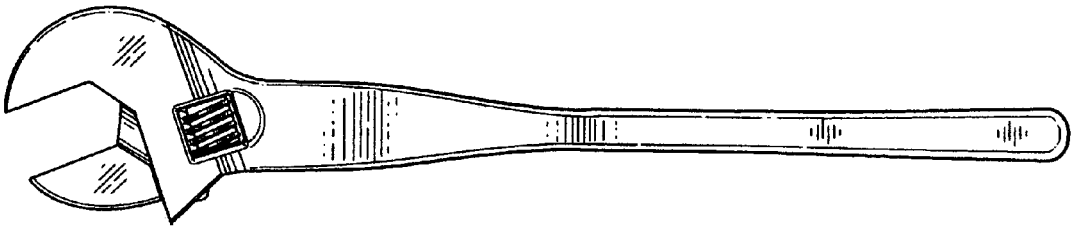

The drawings herein are for the purpose of illustrating preferred embodiments of the present invention and not for the purpose of limiting same.

Referring now to FIGS. 1, 2 and 3, a prior art open-end type wrench is shown respectively in a top plan view, a right side elevational view, and a cross-sectional view. Prior art wrench 3 has a wrench head 5, and wrench handle 9. Wrench head 5 has an axis of wrench rotation 7. In FIG. 2, it can be seen that handle 9 has only a minimal surface area for the application of force by a user to turn and operate wrench head 5 around axis of wrench rotation 7. The relatively thin handle 9 is functionally advantageous for wrench engagement and accessibility, but not for user comfort, torque and ergonomics. In FIG. 3, wrench handle 9 has a cross-sectional shape as shown, and it can be seen that the cross-sectional shape is elongated in a direction substantially perpendicular to the axis of wrench rotation 7. The cross-sectional shape shown remains constant for the entire length of wrench handle 9. The structure of this typical prior art wrench shown here in FIGS. 1, 2 and 3 provides excellent accessibility to fasteners, but only a minimal surface area for the application of force by a user to turn and operate the wrench, thus creating user discomfort and fatigue, while limiting control, torque and continuous-use capabilities.

Referring now to FIGS. 4, 5, 6, 7 and 8, a present invention open-end type wrench is shown respectively in a top plan view, a right side elevational view, and three different cross-sectional views. Wrench 13 comprises a wrench head 15 at one end thereof, and a substantially metallic lever 19 formed as a handle which extends in a longitudinal direction from wrench head 15. The term "metallic" shall be defined herein as any material comprising a metal, including metallic alloys, etc. Wrench head 15 has an imaginary axis of wrench rotation 17, and handle 19 is formed substantially nontwisted comprising a first handle portion 21, a second handle portion 23, and a third handle portion 25. Substantially "nontwisted" shall be defined herein as not being twisted about an imaginary longitudinal axis. First handle portion 21 connects to the wrench head 15, and second handle portion 23 is longitudinally positioned between the first and third handle portions 21 and 25 respectively. Each of the handle portions has a cross-sectional shape when viewed in a cross-sectional plane perpendicular to the longitudinal direction. As can be seen in FIG. 6, the cross-sectional shape of the first handle portion 21 of handle 19 is elongated in a direction substantially perpendicular to the axis of wrench rotation 17. As can be seen in FIG. 8, the cross-sectional shape of the third handle portion 25 of handle 19 is elongated in a direction substantially parallel to the axis of wrench rotation 17. Also, handle portions 21, 23 and 25 each have a location at which there is a defined cross-sectional thickness when wrench 13 is viewed from an end view thereof. Applicant defines "cross-sectional" herein as relating to a cut section of a handle portion with the cut being substantially perpendicular to an imaginary longitudinal axis. Applicant defines "thickness" herein as being the smallest dimension measurable across and through the center of a cut section of a handle portion. It is easy to see and comprehend that the defined cross-sectional thickness of the second handle portion 23 in FIG. 7 is substantially greater than the defined cross-sectional thickness of the third handle portion 25 shown in FIG. 8. In preferred embodiments of the present invention, the second handle portion has a cross-sectional thickness substantially greater than a cross-sectional thickness of the third handle portion to achieve the strength and ergonomic objectives of the present invention set forth herein. The difference in cross-sectional thickness between a second handle portion and a third handle portion may be slight or great. The second handle portion 23 is the portion of the wrench handle 19 where the cross-sectional shape and orientation of the first handle portion 21 changes and transitions into the cross-sectional shape and orientation of the third handle portion 25. This transition is cleverly achieved without the planar rotation or longitudinal twisting of prior art, twisted wrenches. In FIG. 5, it can be seen that the first handle portion 21 connecting to wrench head 15 is relatively thin so that wrench 13 can easily access and engage with fasteners in common or limited-access environments. Accordingly, the relatively thin handle portion 21 is functionally advantageous for wrench engagement and accessibility. It can also be seen in FIG. 5 that the third handle portion 25 is relatively wide, providing a comfortable and ample surface area for the application of force by a user to turn wrench 13 about axis of wrench rotation 17. Accordingly, the novel wrench configuration of the present invention wrench shown here in FIGS. 4, 5, 6, 7 and 8 provides excellent user control, comfort and torque capabilities while minimizing user fatigue and tool related injuries, without sacrificing wrench strength or accessibility to fasteners.

Referring now to FIGS. 9, 10, 11, 12 and 13, a prior art ratchet type wrench is shown respectively in a top plan view, a right side elevational view, and three different cross-sectional views. Wrench 33 comprises a wrench head 35 at one end thereof, and an elongated handle 39 extending in a longitudinal direction from wrench head 35 as shown. Wrench head 35 has an imaginary axis of wrench rotation 37. A "wrench head" shall be further defined herein as a section of the wrench circularly determined by an outer surface of a longitudinal end of the wrench, with the center of curvature coincidental with the axis of wrench rotation. Therefore, when viewing FIG. 9 the part of wrench 33 considered to be the wrench head 35, is circularly determined by an outer surface 34 of a longitudinal end of the wrench 33, with the center of curvature 36 coincidental with the axis of wrench rotation 37. Elongated wrench handle 39 comprises a first handle portion 41, a second handle portion 43, and a third handle portion 45. The first handle portion 41 connects to the wrench head 35, and the second handle portion 43 is longitudinally positioned between the first and third handle portions 41 and 45 respectively. Each of the handle portions has a cross-sectional shape when viewed in a cross-sectional plane perpendicular to the longitudinal direction. As can be seen in FIG. 11, the cross-sectional shape of the first handle portion 41 of handle 39 is elongated in a direction substantially perpendicular to the axis of wrench rotation 37. As seen in FIG. 13, the cross-sectional shape of the third handle portion 45 of handle 39 is circular in shape. And, as seen in FIG. 12, the cross-sectional shape of the second handle portion 43 of handle 39 is circular in shape. Also, handle portions 41, 43 and 45 each have a location at which there is a defined cross-sectional thickness when wrench 33 is viewed from an end view thereof. Applicant defines "cross-sectional" herein as relating to a cut section of a handle portion with the cut being substantially perpendicular to an imaginary longitudinal axis. Applicant defines "thickness" herein as being the smallest dimension measurable across and through the center of a cut section of a handle portion. It is easy to see and comprehend that the defined cross-sectional thickness of the second handle portion 43 in FIG. 12 is substantially less than the defined cross-sectional thickness of the third handle portion 45 shown in FIG. 13. Such a prior art handle configuration directly contradicts the handle configuration of the preferred embodiments of the present invention, whereas, preferred embodiments of the present invention have a second handle portion with a defined cross-sectional thickness substantially greater than the defined cross-sectional thickness of a third handle portion. The structure of this typical prior art ratchet wrench shown here in FIGS. 9, 10, 11, 12 and 13 does not provide optimal accessibility to fasteners, nor does it provide an optimal surface area for the application of force by a user to turn and operate the wrench, thus creating user discomfort and fatigue, while limiting control, torque and continuous-use capabilities.

Referring now to FIGS. 14, 15, 16, 17 and 18, a present invention ratchet type wrench is shown respectively in a top plan view, a right side elevational view, and three different cross-sectional views. Wrench 53 comprises a wrench head 55 at one end thereof, and a substantially metallic lever 59 formed as a handle which extends in a longitudinal direction from wrench head 55. Again, the term "metallic" shall be defined herein as any material comprising a metal, including metallic alloys, etc. Wrench head 55 has an imaginary axis of wrench rotation 57, and handle 59 is formed substantially nontwisted comprising a first handle portion 61, a second handle portion 63 and a third handle portion 65. Again, substantially "nontwisted" shall be defined herein as not being twisted about an imaginary longitudinal axis. First handle portion 61 connects to wrench head 55, and second handle portion 63 is longitudinally positioned between the first and third handle portions 61 and 65 respectively. Each of the handle portions has a cross-sectional shape when viewed in a cross-sectional plane perpendicular to the longitudinal direction. As can be seen in FIG. 16, the cross-sectional shape of the first handle portion 61 of handle 59 is elongated in a direction substantially perpendicular to the axis of wrench rotation 57. As can be seen in FIG. 18 the cross-sectional shape of the third handle portion 65 of handle 59 is elongated in a direction substantially parallel to the axis of wrench rotation 57. Also, handle portions 61, 63 and 65 each have a location at which there is a defined cross-sectional thickness when wrench 53 is viewed from an end view thereof. Applicant defines "cross-sectional" herein as relating to a cut section of a handle portion with the cut being substantially perpendicular to an imaginary longitudinal axis. Applicant defines "thickness" herein as being the smallest dimension measurable across and through the center of a cut section of a handle portion. It is easy to see and comprehend that the defined cross-sectional thickness of the second handle portion 63 in FIG. 17 is substantially greater than the defined cross-sectional thickness of the third handle portion 65 shown in FIG. 18. In preferred embodiments of the present invention, the second handle portion has a cross-sectional thickness substantially greater than a cross-sectional thickness of the third handle portion to achieve the strength and ergonomic objectives of the present invention set forth herein. The difference in cross-sectional thickness between a second handle portion and a third handle portion may be slight or great. The second handle portion 63 is the portion of the wrench handle 59 where the cross-sectional shape and orientation of the first handle portion 61 changes and transitions into the cross-sectional shape and orientation of the third handle portion 65. This transition is cleverly achieved without the planar rotation or longitudinal twisting of prior art, twisted wrenches. In fact, the structure of the present invention shown here provides a more comfortable surface area for the application of torque by a user than many prior art wrenches having added plastic or vinyl type grips. Although the present invention could easily have plastic or vinyl type grips, applicant believes that such grips are generally nondurable, add cost to the wrench, and reduce wrench engagement accessibility in limited-access work environments. Accordingly, preferred embodiments of the present invention have a metallic lever formed as a handle without large plastic or vinyl type grips. It can be seen in FIG. 15 that the third handle portion 65 is relatively wide, providing a comfortable and ample surface area for the application of force by a user to turn wrench 53 about axis of wrench rotation 57. Accordingly, the novel wrench configuration of the present invention wrench shown here in FIGS. 14, 15, 16, 17 and 18 provides excellent user control, comfort and torque capabilities while reducing user fatigue and tool related injuries, without sacrificing wrench strength or accessibility to fasteners.

Figure 20:
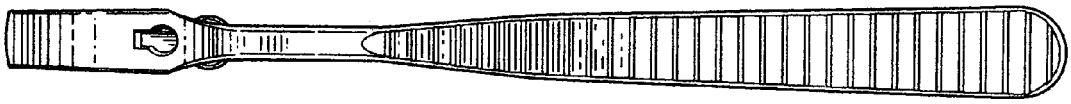
Figure 21:
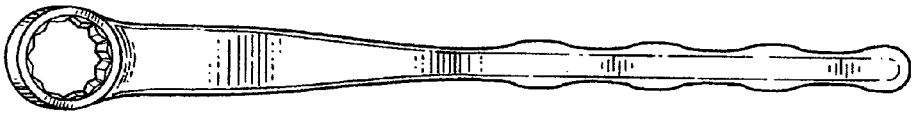
Figure 22:
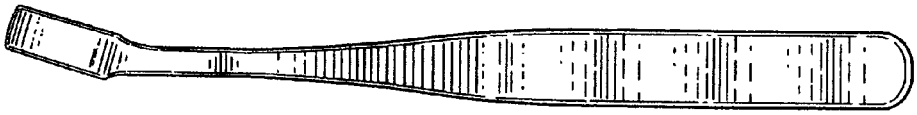

FIG. 19 is a bottom plan view of a present invention adjustable type wrench; and, FIG. 20 is a right side elevational view of the present invention wrench shown in FIG. 19; and, FIG. 21 is a top plan view of a present invention box type wrench; and, FIG. 22 is a right side elevational view of the present invention wrench shown in FIG. 21.

Figure 23:
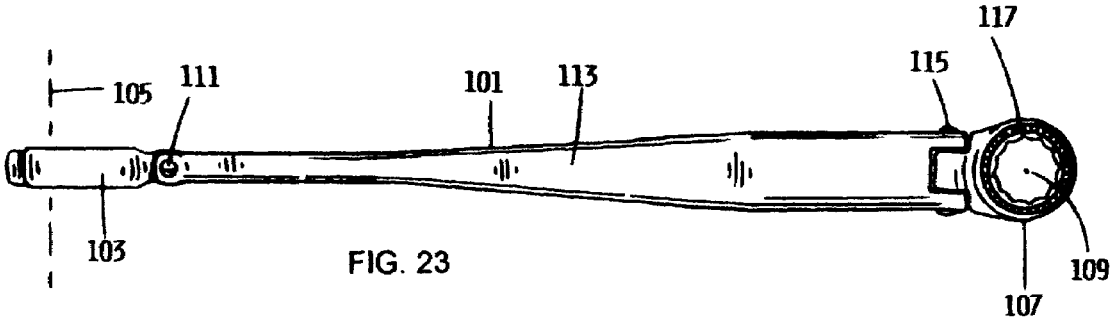
FIG. 23 shows a left side, elevational view of an embodiment of the present invention wherein a wrench head at each end is pivotally connected to a wrench handle portion.

FIG. 23 shows a left side, elevational view of an embodiment of the present invention wherein a wrench head at each end is pivotally connected to a wrench handle portion. Wrench 101 has a wrench head 103 with an imaginary axis of wrench rotation 105; and, wrench head 107 with imaginary axis of wrench rotation 109. Pivot axle 111 is used to pivotally connect wrench head 103 to wrench handle 113, and, pivot axle 115 is used to pivotally connect wrench head 107 to wrench handle 113 of wrench 101. Wrench 101 is shown in a non-pivoted position. Wrench head 107 also has a ratcheting mechanism 117 to expedite the wrenching process. Accordingly, a wrench head of the present invention may be fixedly or pivotally connected to a handle portion. And, a wrench head of the present invention may also be open-ended, closed-ended and/or comprise a ratcheting mechanism to expedite the wrenching process.

When considering the present invention, simplicity and obviousness should not be confused or considered the same. Accordingly, the novelty and complexity of the present invention must be measured in part by the many interrelated objectives set forth herein including accessibility, comfort, torque, strength, durability and ergonomic considerations.

Upon reading and understanding the specification of the present invention described above, modifications and alterations will become apparent to those skilled in the art. It is intended that all such modifications and alterations be included insofar as they come within the scope of the patent as claimed or the equivalence thereof.

Having thus described the invention, the following is claimed:

1. A hand operable wrench comprising a wrench head at one end thereof, and a substantially metallic lever formed as a handle extending in a longitudinal direction from said wrench head; said wrench head having an imaginary axis of wrench rotation, said handle being formed substantially nontwisted comprising a first handle portion, a second handle portion and a third handle portion, said first handle portion connecting to said wrench head, said second handle portion being longitudinally positioned between said first and third handle portions, said first and third handle portions each having a cross-sectional shape when viewed in a cross-sectional plane substantially perpendicular to said longitudinal direction, the cross-sectional shape of said first handle portion being elongated in a direction substantially perpendicular to the axis of wrench rotation of said wrench head, and, the cross-sectional shape of said third handle portion being elongated in a direction substantially parallel to the axis of wrench rotation of said wrench head.

2. A wrench of claim 1, wherein said wrench handle is formed as a one piece handle.

3. A wrench of claim 1, wherein said wrench head comprises a ratcheting mechanism so as to form a ratcheting type wrench.

4. A wrench of claim 1, wherein said wrench head comprises an adjustable means so as to form an adjustable type wrench.

5. A wrench of claim 1, wherein said wrench head is open-ended so as to form an open-end type wrench.

6. A wrench of claim 1, wherein said wrench head is closed so as to form a box type wrench.

7. A wrench of claim 2, wherein said wrench head comprises a ratcheting mechanism so as to form a ratcheting type wrench.

8. A wrench of claim 2, wherein said wrench head comprises an adjustable means so as to form an adjustable type wrench.

9. A wrench of claim 2, wherein said wrench head is open-ended so as to form an open-end type wrench.

10. A wrench of claim 2, wherein said wrench head is closed so as to form a box type wrench.

11. A hand operable wrench comprising a wrench head at one end thereof, and a substantially metallic lever formed as a handle extending in a longitudinal direction from said wrench head; said wrench head having an imaginary axis of wrench rotation, said handle being formed substantially nontwisted comprising a first handle portion, a second handle portion and a third handle portion, said first handle portion connecting to said wrench head, said second handle portion being longitudinally positioned between said first and third handle portions, said first and third handle portions each having a cross-sectional shape when viewed in a cross-sectional plane substantially perpendicular to said longitudinal direction, the cross-sectional shape of said first handle portion being elongated in a direction substantially perpendicular to the axis of wrench rotation of said wrench head, the cross-sectional shape of said third handle portion being elongated in a direction substantially parallel to the axis of wrench rotation of said wrench head, each said handle portion having a location at which there is a defined cross-sectional thickness when said wrench is viewed from an end view thereof, and, the second handle portion having a cross-sectional thickness substantially greater than a cross-sectional thickness of said third handle portion.

12. A wrench of claim 11, wherein said wrench handle is formed as a one piece handle.

13. A wrench of claim 11, wherein said wrench head comprises a ratcheting mechanism so as to form a ratcheting type wrench.

14. A wrench of claim 11, wherein said wrench head comprises an adjustable means so as to form an adjustable type wrench.

15. A wrench of claim 11, wherein said wrench head is open-ended so as to form an open-end type wrench.

16. A wrench of claim 11, wherein said wrench head is closed so as to form a box type wrench.

17. A hand operable wrench comprising a wrench head at one end thereof, and a substantially metallic lever formed as a handle extending in a longitudinal direction from said wrench head; said wrench head having an imaginary axis of wrench rotation, said handle being formed substantially nontwisted comprising a first handle portion, a second handle portion and a third handle portion, said first handle portion being pivotally connected to said wrench head, said second handle portion being longitudinally positioned between said first and third handle portions, said first and third handle portions each having a cross-sectional shape when viewed in a cross-sectional plane substantially perpendicular to said longitudinal direction, and, when said wrench is in a non-pivoted position the cross-sectional shape of said first handle portion being elongated in a direction substantially perpendicular to the axis of wrench rotation of said wrench head, and the cross-sectional shape of said third handle portion being elongated in a direction substantially parallel to the axis of wrench rotation of said wrench head.

* * * * *